US005295534A

United States Patent [19]

Porter

[11] Patent Number: 5,295,534

[45] Date of Patent: Mar. 22, 1994

[54] PRESSURE MONITORING OF A PRODUCING WELL

[75] Inventor: Joseph L. Porter, New Iberia, La.

[73] Assignee: Texaco Inc., White Plains, N.Y.

[21] Appl. No.: 906,075

[22] Filed: Jun. 29, 1992

Related U.S. Application Data

[63] Continuation of Ser. No. 685,573, Apr. 15, 1991, abandoned.

[51] Int. Cl.[5] ..... E21B 34/08

[52] U.S. Cl. ..... 166/75.1; 137/460; 137/462; 137/513.3; 166/91; 166/319; 166/324

[58] Field of Search ..... 166/363, 364, 335-337, 166/319, 325, 324, 320, 91, 75.1, 113; 137/458, 459, 460, 461, 462, 513.3

[56] References Cited

U.S. PATENT DOCUMENTS

| | | | |
|---|---|---|---|
| 2,121,936 | 6/1938 | Thomas | 166/324 X |
| 2,806,484 | 9/1957 | Schultz | 137/460 |
| 3,122,162 | 2/1964 | Sands | 137/513.3 X |
| 3,319,717 | 5/1967 | Chenoweth | 166/320 X |
| 3,561,471 | 2/1971 | Sands | 137/462 X |
| 3,712,129 | 1/1973 | Rhoades | 73/151 |
| 3,794,077 | 2/1974 | Fanshier | 137/513.3 |
| 4,080,988 | 3/1978 | Robertson | 137/513.3 X |
| 4,230,187 | 10/1980 | Seto et al. | 166/336 |
| 4,574,833 | 3/1986 | Custer | 137/460 X |

FOREIGN PATENT DOCUMENTS 2924533 1/1981 Fed. Rep. of Germany ..... 137/460

OTHER PUBLICATIONS

G. M. Raulins, SPE 3491, 4 pages.

*Primary Examiner*—Hoang C. Dang

*Attorney, Agent, or Firm*—James J. O'Loughlin; Ronald G. Gillespie

[57] ABSTRACT

A well pressure monitoring system in which a hydrocarbon fluid is being produced through a Christmas tree or similar flow controller apparatus. Well pressure is transmitted through a tap-off communicated to a pressure sensor. The prssure is thereafter transmitted to a base or control station. To avoid a major uncontrolled flow of the hydrocarbon from the well in the event of inadvertent breakage or accident to the monitoring system, an excess flow control valve is positioned between the well flow and the pressure sensor. The excess flow valve functions to cut off fluid flow, but is provided with a vent passage in the valve actuator through which a minimal amount of the hydrocarbon can escape. When the damage to the monitoring system has been overcome, the vent passage will allow a downstream pressure build-up in the closed system, thus permitting a biasing spring to automatically reset the valve to open and operable position, thereby stabilizing the pressure acting on the actuator.

2 Claims, 3 Drawing Sheets

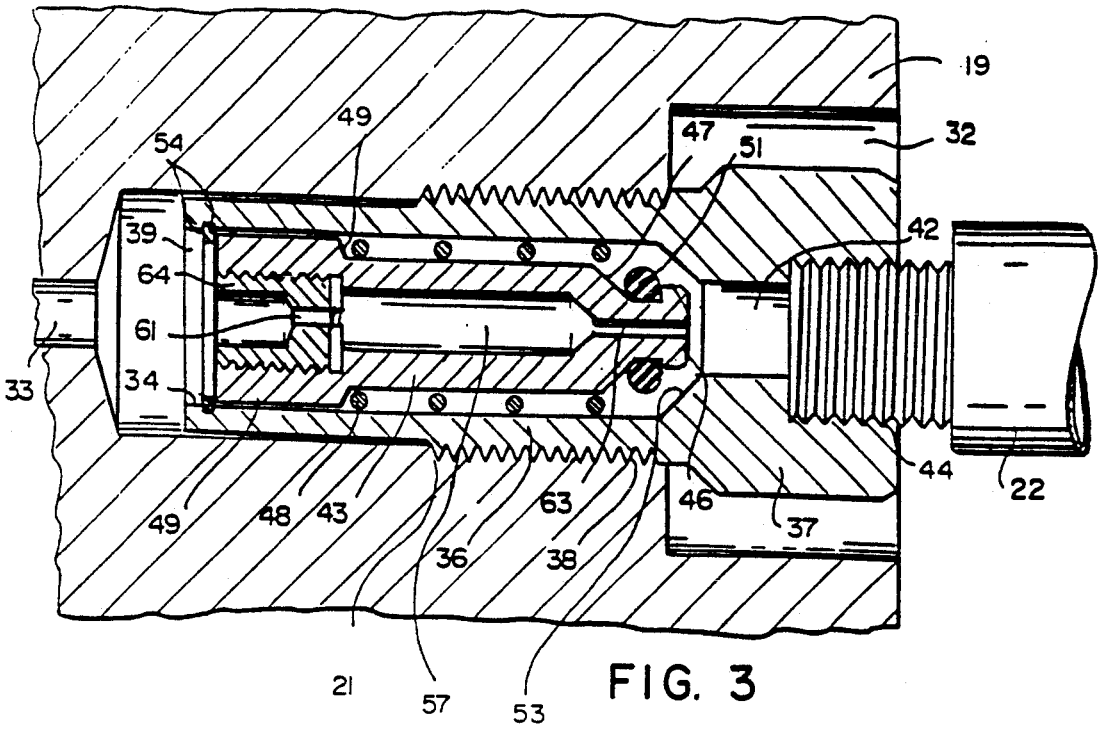
FIG. 3
FIG. 4
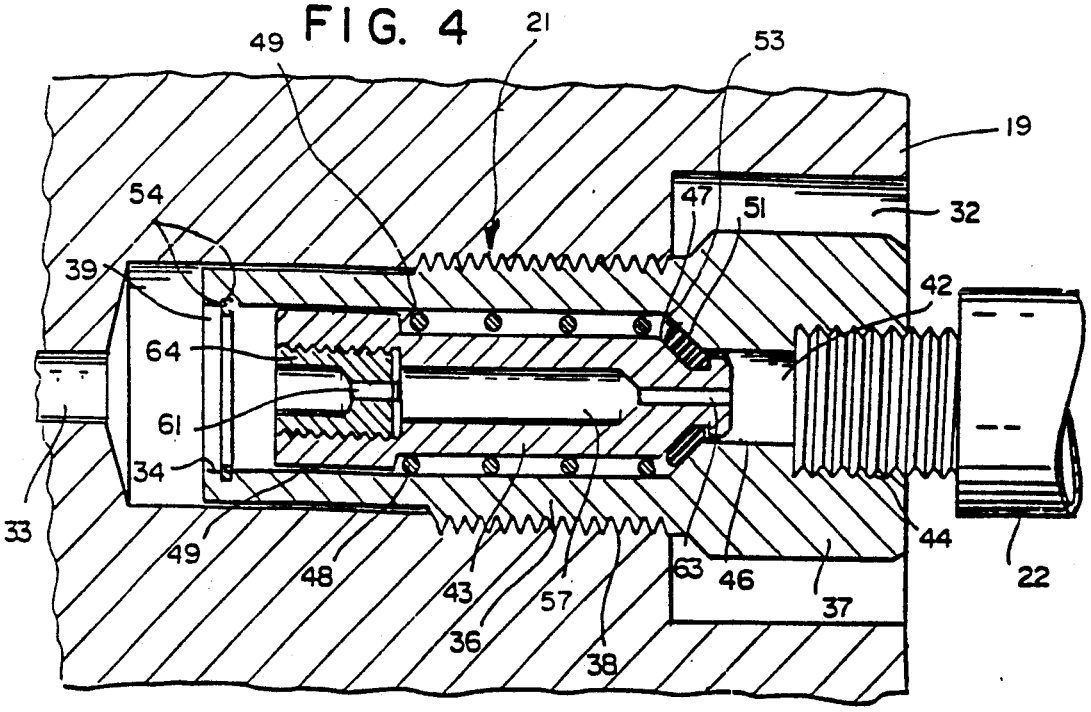

PRESSURE MONITORING OF A PRODUCING WELL

This is a continuation of application Ser. No. 07/685,573, filed Apr. 15, 1991, now abandoned.

BACKGROUND OF THE INVENTION

There are many producing advantages realized by monitoring and regulating performance of a well or series of hydrocarbon producing wells from a central monitoring station remote from the wells. One phase of such a system includes the use of a pressure monitoring apparatus which is communicated with each well. Thus, well pressure can be promptly transmitted by radio to the control station or base.

Apparatus utilized with such a system involves means for tapping into each well's main flow line at some point between the Christmas tree or the well head, and the pipeline which conducts the hydrocarbon fluid. In the event of breakage in the monitoring system, whether through inadvertence, accident or otherwise, it can be appreciated that a considerable amount of hydrocarbon fluid could escape into the atmosphere before corrective measures are taken.

It is known from experience, that the use of an excess flow valve in such an instance would function to cut off flow from a well in the event of a pressure monitoring system malfunction due to breakage or other mishap which fractures the fluid holding lines. Such an incident would normally necessitate a work crew going to the individual well to replace defective parts and to recommence production flow.

In the normal well monitoring operation, an excess flow valve is placed where it will automatically discontinue flow through the monitoring system upon indication that normal static conditions no longer prevail. Although the valve is automatically actuated to closed position, once the defect in the system or the damage is repaired, the valve cannot be readily readjusted to a normal open setting to recommence the monitoring operation.

In the present arrangement, there is provided such a valve which is capable of monitoring excess flow from a hydrocarbon producing well. The valve, as noted above, functions to automatically close in response to a situation wherein a predetermined, excessive volumetric flow of hydrocarbon is flowing through the valve. It further functions when closed, to provide means for automatically adjusting to open position when the downstream condition in the system has been repaired such that pressure monitoring can be continued.

This is achieved by permitting a downstream build-up in the well pressure downstream of the valve to occur through the use of a vent by-pass passage. The latter allows a minimal flow of the well fluid past the valve, which will then be forced into open position by spring pressure.

It is therefore an object of the invention to provide a pressure monitoring system for a producing well wherein an excess flow valve is included in the system to function in a manner that will permit automatically reactivating the system after the system excess flow control valve has closed.

DESCRIPTION OF THE DRAWINGS

FIG. 3 is a cross-sectional view taken along line 3—3 in FIG. 2 with the valve shown in the open position.

FIG. 4 is similar to FIG. 3 with the valve shown in the closed position.

Figure 1:
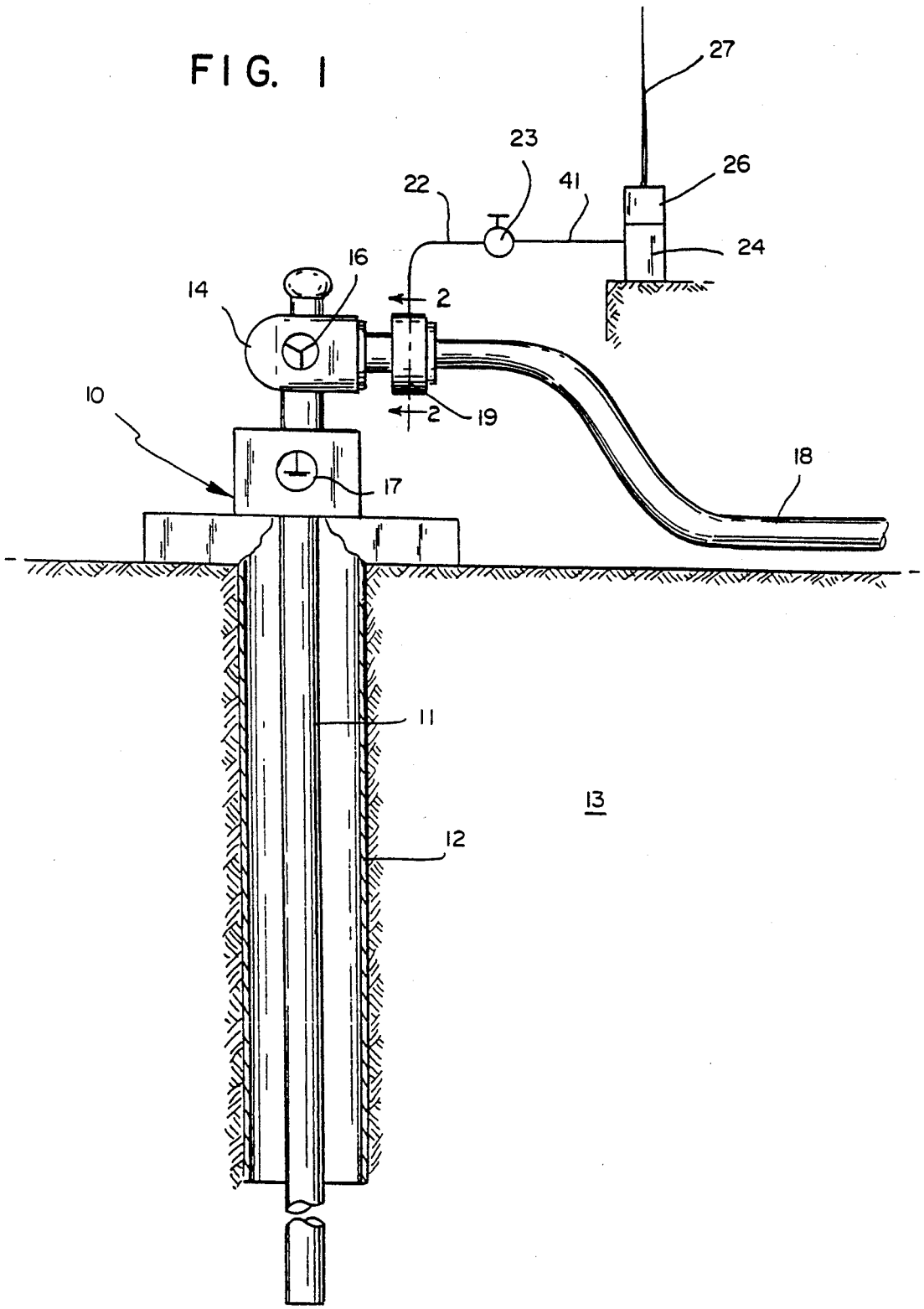
FIG. 1 is an environmental section of a hydrocarbon producing well in which the disclosed monitoring system is utilized.

The invention is illustrated in conjunction with a land based well 10 which is equipped such that a flow pipe 11 and necessary casing 12, are communicated through the substrate 13 to a producing subterranean reservoir. The upper end of flow pipe is provided with a Christmas tree 14 which embodies necessary valving 16 and 17 to regulate the pressure as well as the volume of the hydrocarbon stream. Product is directed from the Christmas tree into a pipeline 18 which conducts the flow to a downstream point for further processing.

Figure 2:
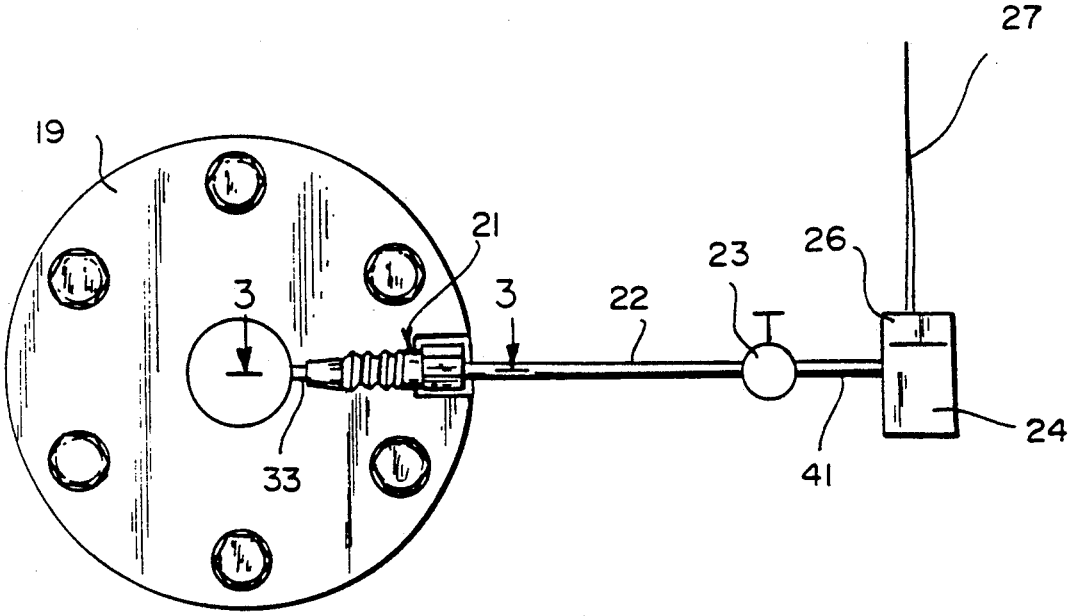
FIG. 2 is an enlarged segmentary view taken along line 2—2 in FIG. 1.
Figure 5:
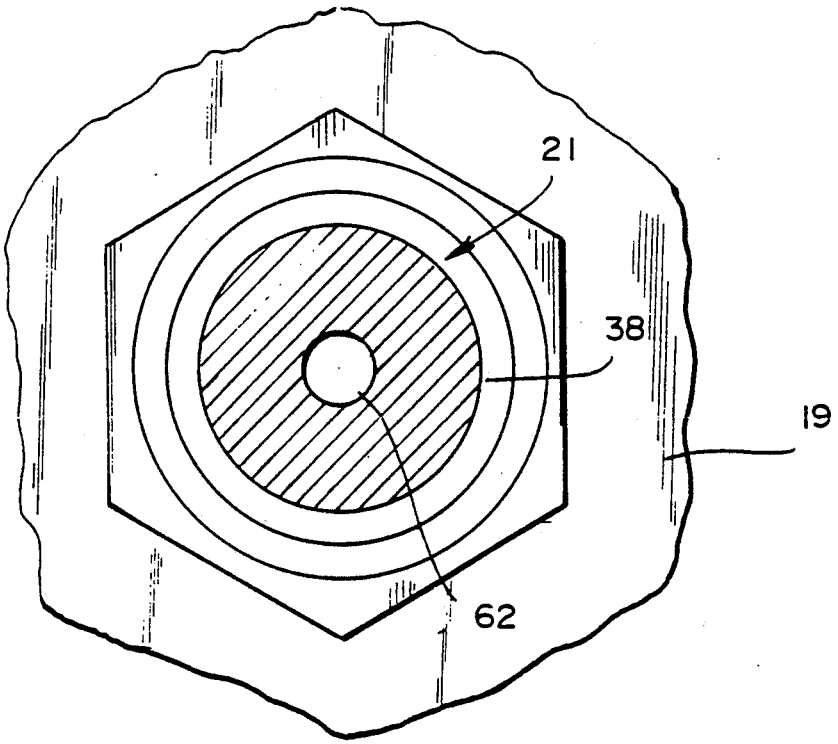

The instant flow monitoring system is incorporated into a part or segment of Christmas tree 14 which is in direct contact with flowing product such that the pressure in the latter can be readily monitored. As illustrated in FIG. 2, the system is incorporated into a flange 19 having a valve 21 through which the hydrocarbon flow passes to pipeline 18.

Fluid pressure or excess flow control valve 21 is communicated by way of a tubing or minimal diameter conduit 22, to a valve 23. Thereafter pressure is transmitted through the fluid filled line 41 to a sensor 24 having the capability of providing instantaneous data indicative of well pressure as the latter fluctuates.

The resulting readings or data can be transmitted by radio waves through radio 26 and antenna 27, to a remote control station.

Referring to FIGS. 2–4, the excess flow control valve 21 is shown removably fitted into a recessed bore 32 of flange 19. The valve recess 32 is in communication by way of passage 33 with the fluid flow passing through the apparatus to pipeline 18.

Excess flow control valve 21 includes primarily an elongated body 36 having a hexagonal head 37 at one end which permits the valve to be threadably introduced into the flange recess 32. Body 36 is therefore provided along its outer surface with a threaded segment 38. Recess 32 is sufficiently deep to register the entire valve body 36 as well as head 37 and thereby avoid any damage coming to the latter.

Inlet end 39 of body 36 is open to receive a flow of the hydrocarbon fluid during initial startup to pressurize the monitoring lines 22 and 41, after which there will be no further flow through these lines. Rather, well pressure will be transferred through the accumulated liquid to contact the pressure sensor 24.

The downstream or head end of body 36 is provided with an internally threaded cavity 44 into which a valve, or conduit 22 can be fixed to complete the closed flow path to pressure sensor 24.

An internal chamber 34 within body 36 between the respective inlet means 39 and discharge port 42 encloses an elongated valve actuator or valve piston 43.

Valve actuator 43 is comprised of a generally cylindrical member having a nose or downstream end 46 which is formed into a cylindrical section. The latter is of such a diameter and disposition as to be capable of slidably registering into the comparable cylindrical section in the body discharge port 42. Similarly, actuator 43 is provided with a frusto conical rim 47 as a continuation of the cylindrical nose 46. Said frusto conical rim substantially matches the corresponding frusto conical shoulder 53 formed in the body discharge port 42.

The main body 36 of valve actuator 43 is space sufficiently apart from the adjacent walls of the connecting chamber 34 to accommodate a forward biasing means such as a coil spring 48. The latter is positioned with an end coil in abutment with frusto conical seating shoulder 53; the other end of spring 48 abuts an outwardly projecting collar 49 toward the upstream end of the actuator.

Physically, coil spring 48 is preset at sufficient strength to maintain valve actuator 43 spaced away from seating position with seating shoulder 53. Thus, and as shown in FIG. 3, the valve is ordinarily maintained in open position by force of spring 48. In the event of a downstream breakage in the system which would trigger a sudden outflow of hydrocarbon fluid through passage 33, the unchecked fluid flow will exert sufficient force against the rear face of the actuator 43 to urge the latter into the forward or closed position. As shown in FIG. 4, nose section or segment 46 will be forced into the corresponding cylindrical segment of section of discharge port 42 to form a metal-to-metal substantial seal.

To supplement the fluid tight integrity of this metal-to-metal seal, nose section 46 is provided with a resilient ring 51 maintained in position within a peripheral ring retainer slot. Thus, as the actuator nose section 46 is urged further into registry with its mating section, resilient seal ring 51 which can be formed of rubber or other similar hydrocarbon deterioration resistant material, is deformed into fluid tight annular engagement. This composite seal arrangement is sufficient to prohibit further movement of the valve element and consequently to obviate any further large scale flow of hydrocarbon through the discharge port 42.

Valve actuator 43 is longitudinally, slidably positioned within valve body 36 to normally allow fluid flow through both the actuator and through the annulus formed between the actuator and the wall of valve body chamber 34. The upstream end of body 36 is thus provided with a retainer ring slot into which a retainer ring 54 is removably positioned. Said ring limits the rearward movement of the actuator when coil spring 48 urges the actuator into open position.

At such time as actuator 43 is urged into closed position with respect to body 36, the only flow through the actuator will be through a bypass in the form of a constricted or limited diameter passage therethrough. In one embodiment, said passage is comprised of an inlet orifice 61 through which the flowing hydrocarbon fluid will pass as it enters an expanded intermediate chamber 57. Said chamber 57 is provided with a discharge opening in the form of a constricted passage or a second orifice 63.

The respective orifices, in order to allow a limited flow of hydrocarbon therethrough, can be in the order of magnitude of 0.015 to 0.030 inches.

In one embodiment of the actuator 43 constricted central passage, the latter is formed coaxially with actuator body 36. Further, one or both constricted passages 61 and 63 can be defined by an individual member such as orifice plug 64 which is threadably positioned within the upstream end of body 36. With this feature, plug 64 can be removed and replaced with a plug having an orifice of a desired size. Plug 64 is provided with a transverse slot to allow replacement thereof.

It is understood that although modifications and variations of the invention can be made without departing from the spirit and scope thereof, only such limitations should be imposed as are indicated in the appended claims.

I claim:

1. A bleed valve for a pressure monitoring system associated with a well head communicated with a pressurized subterranean source of a hydrocarbon fluid, which bleed valve includes (a) an elongated body (36) having inlet means at one end for communicating with said source of pressurized fluid;

(b) a composite discharge port at said elongated body other end having a cylindrical segment (42), and peripheral shoulder (53) adjacent thereto;

(c) means forming an elongated chamber (34) in said elongated body (36) communicating said inlet means with said composite discharge port;

(d) a valve actuator (43) longitudinally adjustable between open and closed positions and operably retained in said means forming said elongated chamber (34), having a nose section (46) at one end engageable to slidably register in said cylindrical segment (42);

(e) said valve actuator (43) including a valve body having a composite valve seat at one end engageable with said composite discharge port and including a resilient ring (51) which sealably engages said peripheral shoulder (53) to define a substantially fluid-tight annular seal when said valve actuator is urged into the closed position;

(f) biasing means (48) engaging said valve actuator (43) to urge said composite valve seat out of closed engagement with said composite discharge port; and (g) means forming an axial bypass channel in said valve actuator (43) defining a passage communicating said inlet means with said composite discharge port when said valve actuator composite valve seat is adjusted to closed position with said composite discharge port.

2. In a bleed valve as defined in claim 1 including a plug (64) removably positioned in said valve actuator, having an orifice means therein defining a portion of said axial by-pass channel.

* * * * *